US005362003A

United States Patent [19]

Virving

[11] Patent Number: 5,362,003

[45] Date of Patent: Nov. 8, 1994

[54] REFINING SEGMENT

[75] Inventor: Nils Virving, Hässelby, Sweden

[73] Assignee: Sunds Defibrator Industries Aktiebolag, Sweden

[21] Appl. No.: 140,063

[22] Filed: Oct. 29, 1993

[30] Foreign Application Priority Data

Jan. 22, 1993 [SE] Sweden ..... 9300078-4

[51] Int. Cl.[5] ..... B02C 7/12

[52] U.S. Cl. ..... 241/261.3; 241/296

[58] Field of Search ..... 241/261.3, 296, 297, 241/261.2

[56] References Cited

U.S. PATENT DOCUMENTS 927,077 7/1909 Richards ..... 241/261.3
1,114,339 10/1914 Bryant .
2,776,800 1/1957 Uschmann ..... 241/296
3,974,971 8/1976 Reinhall ..... 241/261.3

*Primary Examiner*—Douglas D. Watts
*Attorney, Agent, or Firm*—Lerner, David, Littenberg, Krumholz & Mentlik

[57] ABSTRACT

A refining segment for a disc refiner for defibering and processing lignocellulose-containing fiber material. The refining segment has the shape of a circle sector and a refining surface with bars and intermediate grooves, which extend across substantially the entire refining surface. The bars are oblique in relation to the radius of the refining segment, and the angle of the bars in relation to said radius is greatest closest to the center and thereafter decreases in radial outward direction. The angle closest to the center shall be in the interval 20°-45° and farthest out in the interval −10° to +20°.

5 Claims, 1 Drawing Sheet

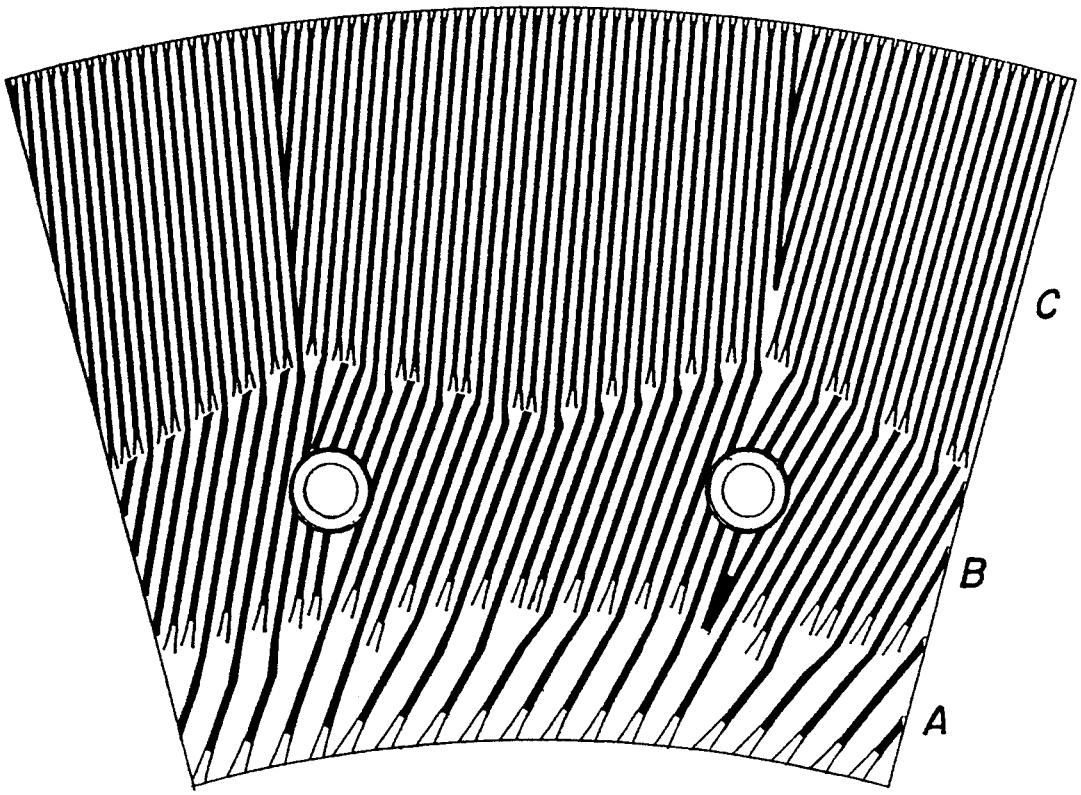
C
B
A

REFINING SEGMENT

FIELD OF THE INVENTION

The present invention relates to refining segments. More particularly, the present invention relates to refining segments which are intended to be used in disk refiners for the defibration and processing of lignocellulose-containing fibrous materials. This invention specifically relates to such refining segments for use in the production of pulp for the paper and board industry.

BACKGROUND OF THE INVENTION

Pulp is generally produced in a refiner which comprises two opposed refining disks, at least one of which is rotary. The lignocellulose-containing material is supplied centrally through one of the disks, and is then disintegrated in the refining gap between the disks, in the presence of water. The refining disks are provided with a plurality of exchangeable refining segments in the shape of a sector of a circle, and they are formed with a refining surface, which is provided with elevations in the form of bars and intermediate grooves. The bars generally extend across substantially the entire refining surface. The direction of the bars can be radial or oblique in relation to the radius.

The fiber material is initially defibered in the refining gap between the refining surfaces; i.e., the fibers are separated. This takes place in the inner portion of the refining gap, where the distance between the refining surfaces is the greatest. As one then proceeds outwardly, the refining gap decreases in size, so as to effectuate the desired processing of the fiber material. To achieve this processing, great amounts of energy are required. Simultaneously, great amounts of steam are generated from the water which is carried with the fiber material.

Depending on the degree of processing which is desired, and thereby on the pulp quality, the refining surfaces can be designed in various ways. Pulp quality is also affected by other factors, such as the size of the refining gap, the liquid content in the fiber material, the feed temperature, etc.

The appearance of the refining surface is of great importance, particularly with regard to the length of the fibers in the processed fiber material. When the bars are oriented substantially radially on the refining surface, a large proportion of long and well-fibrillated fibers are obtained in the pulp. This can be explained by the fact that the fiber material in the refining gap orients itself with the fiber direction substantially parallel with the edges of the bars. The defibering and processing of the fiber material then takes place in such a way that the fiber material is substantially rolled between the bars on opposed refining surfaces, whereby the fibers are separated and fibrillated along their entire length. This type of pulp has high strength, and is thus particularly valuable in many connections, e.g., for newsprint. The energy consumption during production of this type of pulp is relatively high.

When the bars are oriented obliquely in relation to the radius of the refining segment, the proportion of long fibers in the pulp decreases, because the edges of the bars in this case have a cutting effect on the fiber material. At the same time, the fibrillation effect decreases as this cutting effect increases. This type of pulp has considerably lower strength properties, but is particularly suitable for the making of finer paper qualities where formation, printability and opacity are highly valued.

The angle of these bars with respect to the radius is also important for the feed of the material through the refining gap. When the bars are angled obliquely outward, as viewed backward from the direction of rotation thereof, an outward pumping action is obtained, while angling in the opposite direction has a braking effect. The stay time of the material in the refining gap is thus affected by the angle of the bars.

Known refining segments are generally thus designed so as to yield the desired properties of the pulp. This often requires one to make compromises with regard to the design of the refining surfaces in order to obtain a suitable balance between fibrillation and cutting of the fibers and, respectively, between feeding and braking.

It is therefore an object of the present invention to develop a refining segment which can be designed in order to yield optimum pulp while at the same time minimizing the energy consumption therewith.

SUMMARY OF THE INVENTION

These and other objects have now been accomplished by the invention of a refining segment for use in a disk refiner for the refining of lignocellulose-containing fibrous materials which comprises a section of a circle having a predetermined radius and including a refining surface comprising a plurality of raised bars and alternating grooves therebetween covering substantially the entire refining surface of the refining segment. The refining segment includes a plurality of radial refining zones including at least an inner refining zone and an outer refining zone, and the plurality of raised bars in the inner refining zone extending outwardly at an angle with respect to the predetermined radius of the refining segment of between about $+20°$ and $+45°$, and the plurality of raised bars in the outer refining zone extending outwardly at an angle with respect to the predetermined radius of the refining segment of between about $-10°$ and $+20°$. The angles between the raised bars in the predetermined radius are seen with respect to the direction of rotation the refining segment when in use.

In accordance with one embodiment of the refining segment of the present invention, the plurality of radial refining zones includes an intermediate refining zone between the inner refining zone and the outer refining zone, and the plurality of raised bars in the intermediate refining zone extend outwardly at an angle with respect to the predetermined radius which is intermediate the angle of the plurality of raised bars in the inner refining zone and the angle of the plurality of raised bars in the outer refining zone with respect to the predetermined radius. Preferably, the plurality of raised bars in each of the inner, intermediate and outer refining zones include at least one group of raised bars arranged substantially parallel to each other.

In another embodiment, the plurality of raised bars in each of the inner, intermediate and outer refining zones extend outwardly at substantially the same angle with respect to the predetermined radius.

In accordance with another embodiment of the refining segment of the present invention, the refining segment includes at least one intermediate refining zone between the inner refining zone and the outer refining zone, and the angle of the plurality of raised bars in each of the plurality of refining zones with respect to the predetermined radius decreases successively from the inner refining zone to the outer refining zone.

According to this invention, the raised bars are oblique in relationship to the radius of the refining segment, and the angle of the raised bars in relation to that radius is the greatest closest to the center and thereafter decreases as one passes radially outwardly. The angle closest to the center should thus be between about +20° and +45°, preferably between +25° and +40°, and the angle furthest out should be between about −10° and +20°. The bars can be divided into several such radial zones, each of which can include one or several groups of bars where the raised bars are substantially mutually parallel within each such group. Alternatively, the raised bars within a given zone can form substantially the same angle with respect to the radius. It is also possible to arrange the raised bars so that their angle decreases successively across the refining surface.

BRIEF DESCRIPTION OF THE DRAWING

The present invention can be more fully appreciated with reference to the Figure, in which is shown a top, elevational partially schematic view of the refining surface of a refining segment according to the present invention.

DETAILED DESCRIPTION

Referring to the Figure, the refining surface of the refining segment shown therein divided into three zones, each of which occupies a portion of the radial extension of the refining surface; i.e., an inner zone A, and intermediate zone B, and an outer zone C. Each such zone is provided with bars forming an angle with the radius of the refining segment. In the inner zone A this angle should be between about +20° and +45°, preferably between about +25° and +40°. The bars are angled for outward feed when the refining segment is used in a refiner. In zone A, such feed is desired, and at the same time a first defibering of the material takes place. The refining segment is shaped such that the distance between opposed refining segments in the refiner in this inner zone A is so great that neither an appreciable cutting nor fibrillation takes place.

In the intermediate zone B, the angle should be between about +10° and +30°. The bars are still angled for outward feed, but not as much as in the inner zone A. The distance between opposed refining segments in zone B is smaller than that in zone A, and a certain processing of the fibers takes place in this zone. The bar angle in this case implies a balance between feed and processing. In the outer zone C final processing of the fibers takes place. The bar angle in this zone can vary between about −10° and +20°, where a negative means that the bars are angled in the opposite direction in relation to the radius. The desired pulp quality will determine which angle is to be used. A smaller angle yields more fibrillation, and a greater angle yields a higher cutting effect.

In each of zones A, B and C, the bars can be formed into one or several groups, where the bars in each such group are in mutual parallel relationship.

Due to the fact that the angle of the bars is greatest closest to the center and thereafter decreases in the radial direction outwardly, utilization of the refining surface is optimized. This implies that a desired defibering and processing of the fiber material can be obtained along the entire refining segment, while at the same time the energy consumption is minimized.

Instead of dividing the refining surface into three radial zones, more zones can be arranged. The angle of the bars, however, should be in the interval indicated above for each third of the refining surface. It is also possible to decrease the bar angle successively along the refining surface. The bars can then be straight or arched, with outward decreasing angles.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

I claim:

1. A refining segment for use in a disk refiner for the refining of lignocellulose-containing fibrous materials, said refining segment comprising a section of a circle having a predetermined radius and including a refining surface comprising a plurality of raised bars and alternating grooves therebetween covering substantially the entire refining surface of said refining segment, said refining segment including a plurality of radial refining zones including at least an inner refining zone, an intermediate refining zone, and an outer refining zone, said plurality of raised bars in said inner refining zone extending outwardly at an angle with respect to said predetermined radius of said refining segment of between about +20° and +45°, said plurality of raised bars in said outer refining zone extending outwardly at an angle with respect to said predetermined radius of said refining segment of between about −10° and +20°, and said plurality of raised bars in said intermediate refining zone extending outwardly at an angle with respect to said predetermined radius intermediate the angle of said plurality of raised bars in said inner refining zone and said angle of said plurality of raised bars in said outer refining zone with respect to said predetermined radius, said plurality of raised bars in said inner, intermediate and outer refining zones including at least one group of raised bars arranged substantially parallel to each other.

2. The refining segment of claim 1 wherein the angle of said plurality of raised bars in each of said plurality of refining zones with respect to said predetermined radius decreases successively from said inner refining zone to said outer refining zone.

3. A refining segment for use in a disk refiner for the refining of lignocellulose-containing fibrous materials, said refining segment comprising a section of a circle having a predetermined radius and including a refining surface comprising a plurality of raised bars and alternating grooves therebetween covering substantially the entire refining surface of said refining segment, said refining segment including a plurality of radial refining zones including at least an inner refining zone, an intermediate refining zone, and an outer refining zone, said plurality of raised bars in said inner refining zone extending outwardly at an angle with respect to said predetermined radius of said refining segment of between about +20° and +45°, said plurality of raised bars in said outer refining zone extending outwardly at an angle with respect to said predetermined radius of said refining segment of between about −10° and +20°, and said plurality of raised bars in said intermediate refining zone extending outwardly at an angle with respect to said predetermined radius intermediate the angle of said plurality of raised bars in said inner refining zone and said angle of said plurality of raised bars in said outer refining zone with respect to said predetermined radius, said plurality of raised bars in each of said inner, intermediate and outer refining zones each extend outwardly at substantially the same angle with respect to said predetermined radius.

4. A refining segment for use in a disk refiner for the refining of lignocellulose-containing fibrous materials, said refining segment comprising a section of a circle having a predetermined radius and including a refining surface comprising a plurality of raised bars and alternating grooves therebetween covering substantially the entire refining surface of said refining segment, said refining segment including a plurality of radial refining zones including at least an inner refining zone, an intermediate refining zone, and an outer refining zone, said plurality of raised bars in said inner refining zone extending outwardly at an angle with respect to said predetermined radius of said refining segment of between about +20° and +45°, said plurality of raised bars in said outer refining zone extending outwardly at an angle with respect to said predetermined radius of said refining segment of between about −10° and +20°, and said plurality of raised bars in said intermediate refining zone extending outwardly at an angle with respect to said predetermined radius intermediate the angle of said plurality of raised bars in said inner refining zone and said angle of said plurality of raised bars in said outer refining zone with respect to said predetermined radius, said plurality of raised bars in said inner, intermediate and outer refining zones including at least one group of raised bars arranged substantially parallel to each other, and extend outwardly at substantially the same angle with respect to said predetermined radius.

5. A refining segment for use in a disk refiner for the refining of lignocellulose-containing fibrous materials, said refining segment comprising a section of a circle having a predetermined radius and including a refining surface comprising a plurality of raised bars and alternating grooves therebetween covering substantially the entire refining surface of said refining segment, said refining segment including a plurality of radial refining zones including at least an inner refining zone, an intermediate refining zone, and an outer refining zone, said plurality of raised bars in said inner refining zone extending outwardly at an angle with respect to said predetermined radius of said refining segment of between about +20° and +45°, said plurality of raised bars in said outer refining zone extending outwardly at an angle with respect to said predetermined radius of said refining segment of between about −10° and +20°, and said plurality of raised bars in said intermediate refining zone extending outwardly at an angle with respect to said predetermined radius intermediate the angle of said plurality of raised bars in said inner refining zone and said angle of said plurality of raised bars in said outer refining zone with respect to said predetermined radius, the angle of said plurality of raised bars in each of said plurality of refining zones with respect to said predetermined radius decreases successively from said inner refining zone to said outer refining zone.

* * * * *

UNITED STATES PATENT AND TRADEMARK OFFICE

CERTIFICATE OF CORRECTION

PATENT NO. : 5,362,003

DATED : November 8, 1994

INVENTOR(S) : Nils Virving

It is certified that error appears in the above-identified patent and that said Letters Patent is hereby corrected as shown below:

Column 3, line 53, after "negative", insert --angle--.

Signed and Sealed this

Seventh Day of February, 1995

Bruce Lehman

*Attest:*

BRUCE LEHMAN

*Attesting Officer*

*Commissioner of Patents and Trademarks*